US006176099B1

(12) United States Patent
Hynes

(10) Patent No.: US 6,176,099 B1
(45) Date of Patent: Jan. 23, 2001

(54) ICE MAKING ASSEMBLY FOR REFRIGERATOR

(75) Inventor: John Edward Hynes, Hamilton (CA)

(73) Assignee: CAMCO Inc., Mississauga (CA)

( * ) Notice: Under 35 U.S.C. 154(b), the term of this patent shall be extended for 0 days.

(21) Appl. No.: 09/396,786

(22) Filed: Sep. 15, 1999

(51) Int. Cl.[7] ..... F25C 5/18
(52) U.S. Cl. ..... 62/344; 62/353
(58) Field of Search ..... 62/344, 351, 353

(56) References Cited

U.S. PATENT DOCUMENTS

| | | | |
|---|---|---|---|
| 2,717,503 | 9/1955 | Woehler | 62/351 |
| 3,048,986 | 8/1962 | Archer | 62/353 |
| 3,151,668 | 10/1964 | Zimmermann | 62/344 |
| 3,418,823 | 12/1968 | Salimbeni Vivai | 62/353 |
| 3,437,244 | 4/1969 | Alvarez et al. | 222/240 |
| 3,621,668 | 11/1971 | Swerbinsky | 62/344 |
| 3,902,331 | 9/1975 | True, Jr. et al. | 62/344 |
| 4,045,979 | 9/1977 | Mazzini | 62/352 |
| 4,084,725 | 4/1978 | Buchser | 62/344 |
| 4,614,088 | 9/1986 | Brooks | 62/344 |
| 4,753,081 | 6/1988 | Koeneman et al. | 62/69 |
| 4,838,026 | 6/1989 | Searl | 62/353 |
| 4,852,359 | 8/1989 | Mazzotti | 62/68 |
| 4,942,979 | 7/1990 | Linstromberg et al. | 221/75 |

*Primary Examiner*—William E. Tapolcai

(57) ABSTRACT

An ice making assembly for use in a refrigerator has an ice forming chamber positioned in the freezer. The chamber has a water reservoir for receiving water, at least one air inlet passage and an outlet opening for permitting cool air flow to pass through the ice forming chamber and over the water reservoir to chill the water into ice pieces. The chamber has an ice displacing device for displacing the ice pieces from the water reservoir and moving the ice pieces out of the ice forming chamber through the outlet opening into an ice storage bin. The bin has a discharge opening for discharging ice pieces from the ice making assembly. The ice making assembly has a downwardly extending baffle positioned across outlet opening of the ice forming chamber. The baffle is slanted from the vertical back towards the outlet opening of the ice making chamber by an angle of about 5° to partially close the outlet opening and to redirect a portion of the air flow normally exiting the outlet opening back into the ice forming chamber and over the water reservoir. The baffle advantageously redirects air flow back over the water to be chilled thereby increasing the heat exchange between the air flow and water without increasing the energy requirements to effect this heat exchange. The improved heat transfer quickens the freezing of the water into ice pieces or cubes.

7 Claims, 2 Drawing Sheets

ICE MAKING ASSEMBLY FOR REFRIGERATOR

TECHNICAL FIELD OF THE INVENTION

The present invention relates to an ice making assembly for use in a refrigerator, and in particular relates to the use of a baffle positioned in the air flow cooling stream to improve the ice making process.

BACKGROUND OF THE INVENTION

In the modem domestic refrigerators it is common to provide an ice making assembly in the freezer compartment of the refrigerator. The ice making assembly includes a water reservoir into which water is supplied. The water is then chilled to form ice pieces. The ice pieces or cubes, are then moved to a storage bin where they are held until the user accesses ice from the refrigerators through an ice dispenser typically mounted through the door of the refrigerator.

When a user obtains ice through the ice dispenser in the door of the refrigerator, a button is usually pressed which controls the delivery of the ice from the storage bin to the user. Also, this action controls the making of ice in the ice making assembly. When a user requires substantial amounts of ice from the refrigerators, the ice storage bin may not hold sufficient amounts of ice to meet the demands of the user. Accordingly, the user has to wait for the ice making device to make more ice. The time required to make ice is a dependent upon the temperature of water being filled into the ice making reservoir and of the temperature of the cooling air passing over the ice in the of the water reservoir. Currently, it may take as long as 3 hours for the ice maker to form ice pieces for delivery to a user.

Currently, in many ice making assembly, air flow is through the ice making machine above the water reservoir. Consequently, the heat exchange between the air flow and water is limited to the passage of air over the water because the air passes directly out of the ice forming chamber. In this type of ice making assembly, there is a need to improve the cooling or freezing efficiency of the ice maker without increasing the energy consumed by it the ice maker.

SUMMARY OF THE INVENTION

In order to improve the efficiency of the ice making process within an ice making assembly, the present invention incorporates the use of an air flow deflection baffle located within the ice making assembly. The air flow baffle is positioned across an outlet opening in the ice forming chamber. The baffle acts to redirect air normally passing out of the outlet opening back into the ice forming chamber and over the water seated in the water reservoir so as to increase the heat exchange between the water being chilled and the coolant air flow within the ice forming chamber. The use of the this air flow baffle results in increasing the speed at which the ice pieces are formed without requiring additional energy. In particular, where the ice normally takes about 3 hours to be formed, the process now takes about 25% less time with the use of the baffle of the present invention.

In accordance with an aspect of the present invention there is provided an ice making assembly for use in a refrigerator having a freezer compartment. The ice making assembly has an ice forming chamber positioned in the freezer compartment adjacent a rear wall of the freezer compartment. The ice forming chamber has a water reservoir for receiving water, at least one air inlet passage and an outlet opening for permitting cool air flow to pass through the ice forming chamber, over the water reservoir, chilling the water into ice pieces, and out the outlet opening. The ice forming chamber has an ice displacing device for displacing the ice pieces from the water reservoir and moving the ice pieces out of the ice forming chamber through the outlet opening. The ice making assembly has an ice storage bin positioned in the freezer compartment forward of and adjacent to the ice forming chamber. The ice storage bin has a first end in air flow communication with the outlet opening so that the air flow and ice pieces passing through the outlet opening pass into the ice storage bin. The ice storage bin has a discharge opening at a second end opposite the first end for discharging ice pieces from the ice making assembly. The ice storage bin has a transport device for moving ice pieces from the first end to the second end and out the discharge opening. The ice making assembly has the improvement of a baffle positioned across the ice forming chamber at the outlet opening and extending downward to partially close the outlet opening and to redirect a portion of the air flow normally exiting the outlet opening back into the ice forming chamber and over the water reservoir.

Advantage is found by using the baffle because the baffle redirects air flow back over the water to be chilled thereby increasing the heat exchange between the air flow and water without increasing the energy requirements to effect this heat exchange. The improved heat transfer quickens the freezing of the water into ice pieces or cubes.

In the preferred embodiment, the baffle is mounted to and extends downwardly from a top wall of the freezer compartment. Alternatively, the baffle extends downwardly from the ice making assembly when the ice making assembly has a top wall. The baffle is preferably slanted from the vertical back towards the outlet opening of the ice making chamber to increase the redirection of the air flow back into the ice forming bin and over the water to be chilled. The baffle is preferably slanted by an angle of about 5° to redirect the air flow and still maintain an effective partial closure for the air outlet opening.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
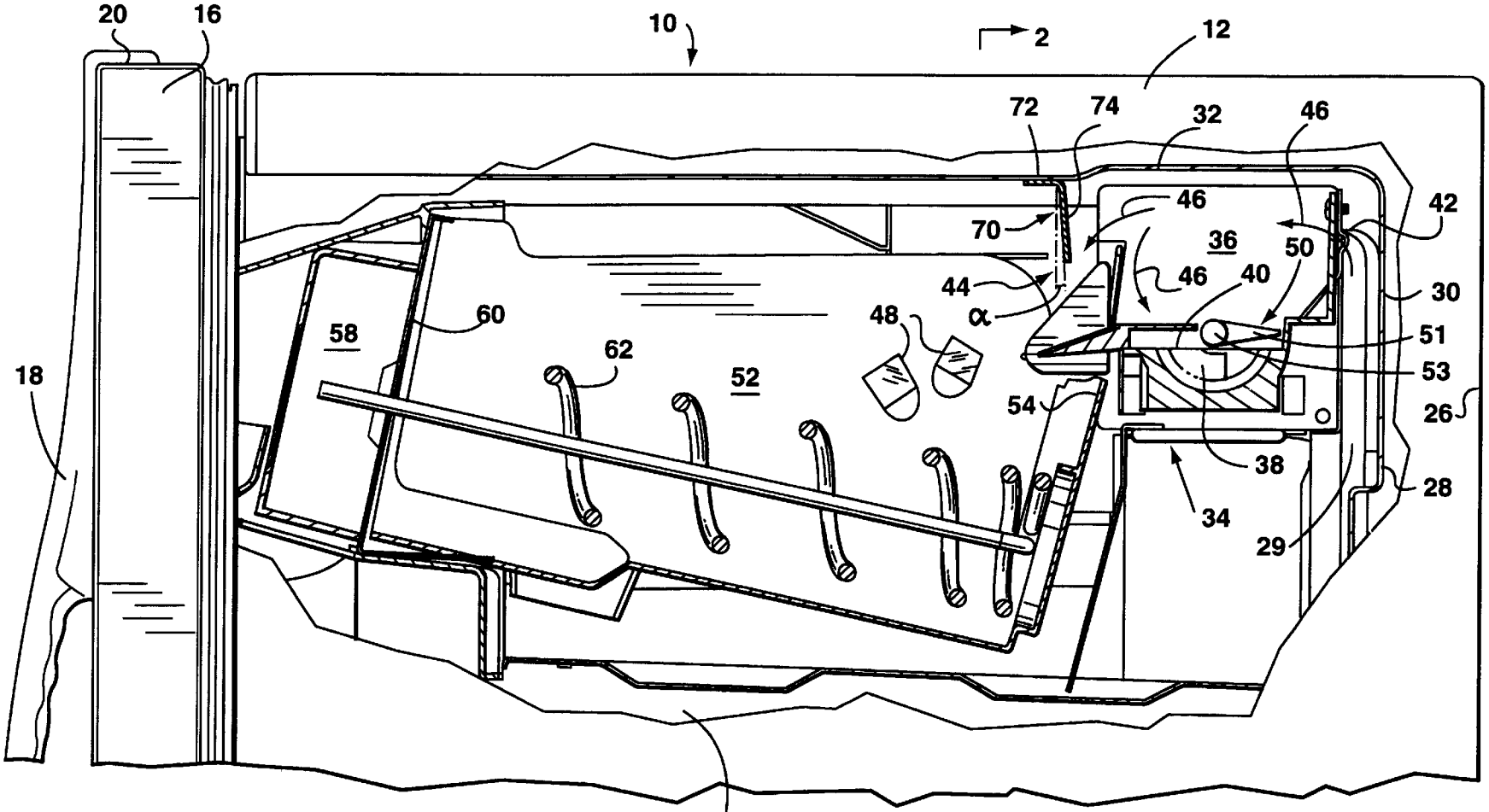
FIG. 1 is a side sectional view of an ice making assembly housed within the freezer compartment of a refrigerator; and, FIG. 2 is a front sectional view taken at lines 2—2 of FIG. 1 showing the construction of the baffle across the outlet opening of the ice forming chamber.
Figure 2:
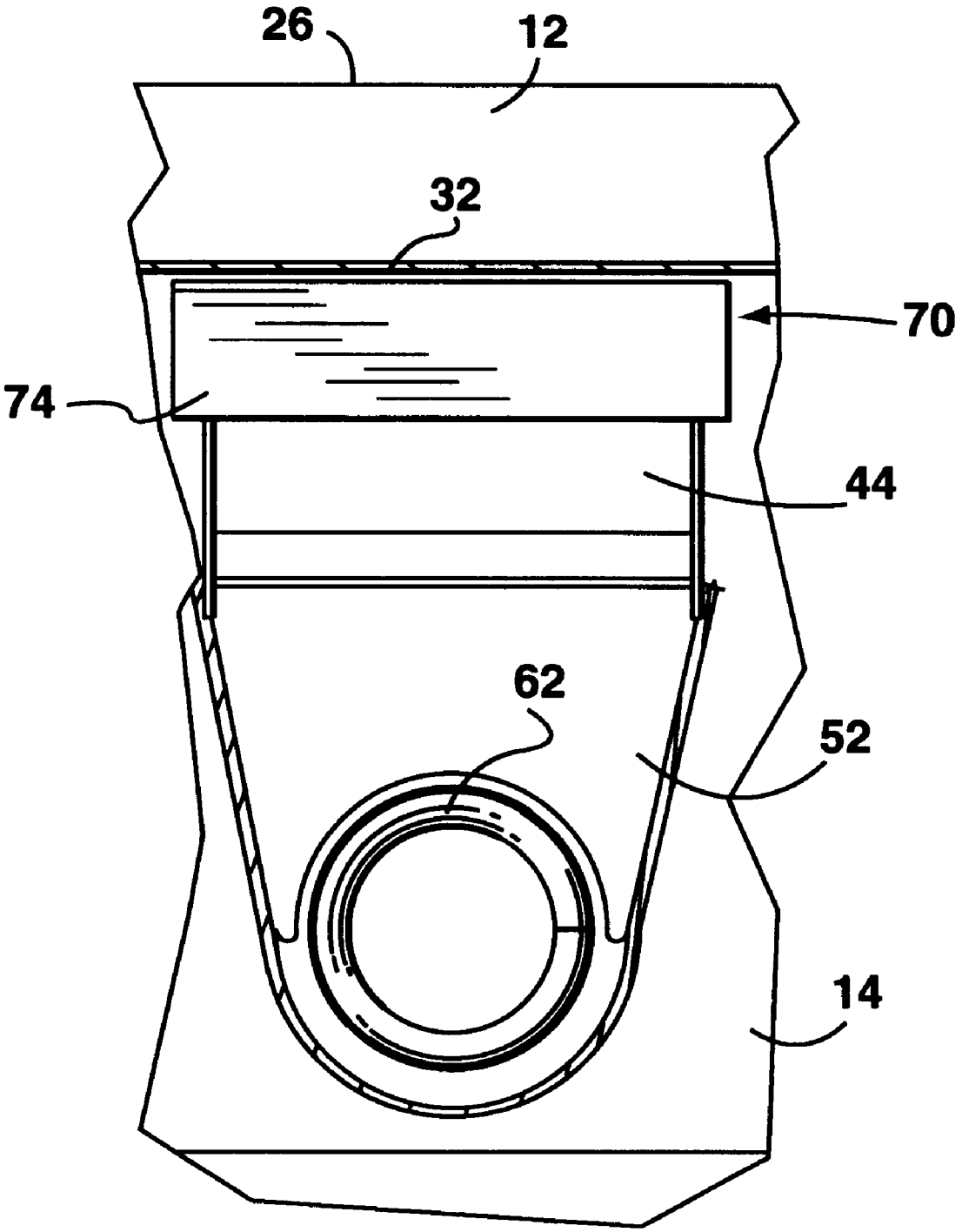

Referring to FIGS. 1 and 2 there is shown a refrigerator 10 comprising a cabinet 12 having a freezer compartment 14 closed by a door 16. The door 16 includes a through the door ice dispenser (not shown) through which ice is discharged from the freezer compartment 14 to a user. Refrigerator 10 as shown is a top mount refrigerator. Alternatively, refrigerator 10 can be a side-by-side refrigerator with of the freezer compartment 14 located beside a refrigerator or fresh food compartment. Door 16 has a handle 18 mounted to the outer metallic casing 20 of the door 16. The cabinet 12 comprises an outer metal wall 26 and an interior plastic liner wall 28 having a rear wall 30 and an upper or top wall 32.

An ice making assembly 34 is mounted within of the freezer compartment 14. The ice making assembly 34 has an ice forming chamber 36. The ice forming chamber 36 is positioned within the freezer compartment 14 in front of the rear liner wall 30 and below of the top liner wall 32.

The ice forming chamber 36 has a water reservoir 38 running across the width of the chamber. The water reservoir 38 includes a series of semicircular recessed slots into which water 40 is filled. The ice forming chamber 36 includes air inlet passages 42 extending through of the rear liner wall 28. A rear wall passage 29 extends behind the ice making chamber 36 down the refrigerator cabinet to the location of the of evaporator housing and evaporator coils where the air in the refrigerator it is normally cooled.

Coolant air as shown by arrow 46 enters the ice forming chamber 36 through the air inlet passages 42. The coolant air 46 passes over the water 40 in the form ice pieces 48. The coolant air 46 then passes out of the ice forming chamber 36 through a outlet opening 44.

The ice forming chamber 36 has an ice displacing device 50 for displacing the ice pieces 48 from the water reservoir 38. The ice displacing device 50 moves the ice pieces 48 out of the ice forming chamber 36 through the outlet opening 44. The ice to displacing device 50 comprises a series of finger like baffles 51 which are rotatable about axis 53. As the baffle 51 is rotated it forces the ice pieces 48 out of the water reservoir 38 through the opening 44 and into an ice storage bin 52.

The ice storage bin 52 is positioned in the freezer compartment 14 forward of an adjacent to the ice forming chamber 36. The ice storage bin 52 has a first end 54 in air flow communication with the outlet opening 44 of the ice forming chambers 36. This permits cool air flow from circulating out of the ice forming chamber 36 and into the storage bin 52 so as to maintain ice pieces 48 located in the storage bin 52 frozen. The ice storage bin 52 has a discharge opening 58 located at the second end 60 opposite to the first end 54. The ice storage bin 52 further includes a transport device 62 which is in the form of a rotating coil which has a spiral shape to move the ice particles 48 from the first end 54 to the second end 60 and out the discharge opening 58.

The ice making assembly further includes an air deflection baffle 70 positioned across the ice forming chamber 36 at the outlet opening 44. The baffle 70 extends downwardly from the top wall 32 of the freezer compartment 14. The baffle is L-shaped and has a first leg 72 of the L adapted to be mounted to the freezer liner wall 32. The second leg L of the baffle is a relatively flat portion 74 that extends downwardly into and across the outlet opening 44 of the ice forming chamber 36. The baffle flat leg 74 is slanted forward towards the ice forming chambers 36 by an angle $\alpha$ of approximately 5 degrees from the vertical. The second baffle leg 74 is a relatively flat sided surface that faces the outlet opening 44. The baffle partially closes the outlet opening 44 and acts to redirect a portion of the air flow 46 within the ice forming chamber 36 back into the ice forming chamber 36 and across the water 40 contained in reservoir 38. This redirection of the air flow 46 by the baffle 70 increases the heat exchange between the air flow 46 and the water 40 without increasing the energy requirements of the refrigerator to improve this heat exchange function. The improved heat change quickens the freezing of the water 40 into ice pieces or ice cubes 48.

As is apparent from the foregoing disclosure, various other embodiments and alterations and modifications which may differ from the embodiments disclosed may be readily apparent to one skilled in the art. It should be understood that the scope of the patent shall be defined by the claims and those embodiments which come within the scope of the claims that follow.

What is claimed is:

1. An ice making assembly for use in a refrigerator having a freezer compartment comprising:

an ice forming chamber positioned in the freezer compartment adjacent a rear wall of the freezer compartment, the ice forming chamber having a water reservoir for receiving water, at least one air inlet passage and an outlet opening for permitting cool air flow to pass through the ice forming chamber, over the water reservoir, chilling the water into ice pieces, and out the outlet opening, and the ice forming chamber having an ice displacing device for displacing the ice pieces from the water reservoir and moving the ice pieces out of the ice forming chamber through the outlet opening;

an ice storage bin positioned in the freezer compartment forward of and adjacent to the ice forming chamber, the ice storage bin having a first end in air flow communication with the outlet opening so that the cool air flow and ice pieces passing through the outlet opening pass into the ice storage bin, the ice storage bin having a discharge opening at a second end opposite the first end for discharging ice pieces from the ice making assembly, the ice storage bin having a transport device for moving ice particles from the first end to the second end and out the discharge opening; and, a baffle positioned across ice forming chamber at the outlet opening and extending downward to partially close the outlet opening and to redirect a portion of the air flow normally exiting the outlet opening back into the ice forming chamber and over the water reservoir.

2. The ice making assembly for use in a refrigerator of claim 1 wherein the baffle is mounted to and extends downwardly from a top wall of the freezer compartment.

3. The ice making assembly for use in a refrigerator of claim 1 wherein the baffle has a flat side facing the outlet opening.

4. The ice making assembly for use in a refrigerator of claim 3 wherein the baffle has a flat side facing the outlet opening and the flat side of the baffle is angled from the vertical back towards the outlet opening.

5. The ice making assembly for use in a refrigerator of claim 3 wherein the baffle is angled about 5° from the vertical back towards the outlet opening.

6. The ice making assembly for use in a refrigerator of claim 2 wherein the baffle is angled about 5° from the vertical back towards the outlet opening.

7. The ice making assembly for use in a refrigerator of claim 2 wherein the at least one air inlet passage passes through the rear wall of the freezer compartment.

* * * * *